US005332657A

United States Patent [19]

Irie et al.

[11] Patent Number: 5,332,657

[45] Date of Patent: Jul. 26, 1994

[54] SILVER HALIDE COLOR PHOTOGRAPHIC LIGHT-SENSITIVE MATERIAL OFFERING EXCELLENT COLOR REPRODUCTION

[75] Inventors: Yasushi Irie, Inagi; Hiroshi Shimazaki, Hachioji; Shinri Tanaka, Urawa, all of Japan

[73] Assignee: Konica Corporation, Tokyo, Japan

[21] Appl. No.: 985,112

[22] Filed: Dec. 3, 1992

[30] Foreign Application Priority Data

Dec. 27, 1991 [JP] Japan ..... 3-346867

[51] Int. Cl.[5] ..... G03C 1/18; G03C 1/29

[52] U.S. Cl. ..... 430/574; 430/567; 430/588; 430/590

[58] Field of Search ..... 430/567, 574, 588, 590

[56] References Cited

U.S. PATENT DOCUMENTS

| | | | |
|---|---|---|---|
| 3,514,450 | 5/1970 | Rauch et al. | 430/588 |
| 3,527,641 | 9/1970 | Nakazawa et al. | 430/574 |
| 3,907,575 | 9/1975 | Shiba et al. | 430/574 |
| 4,028,115 | 6/1977 | Hinata et al. | 430/574 |
| 4,152,163 | 5/1979 | Sato et al. | 430/574 |
| 4,308,345 | 12/1981 | Hinata et al. | 430/574 |
| 4,622,290 | 11/1986 | Tanaka et al. | 430/574 |
| 4,818,676 | 4/1989 | Baba et al. | 430/574 |
| 4,977,074 | 12/1990 | Saitou et al. | 430/567 |
| 5,087,555 | 2/1992 | Saitou | 430/567 |
| 5,096,806 | 3/1992 | Nakamura et al. | 430/567 |
| 5,180,657 | 1/1993 | Fukazaka et al. | 430/574 |
| 5,200,308 | 4/1993 | Ohtani et al. | 430/574 |

FOREIGN PATENT DOCUMENTS

| | | | |
|---|---|---|---|
| 0326853A1 | 8/1989 | European Pat. Off. . | |
| 63-109436 | 5/1988 | Japan | 430/574 |

*Primary Examiner*—Janet C. Baxter

*Attorney, Agent, or Firm*—Finnegan, Henderson, Farabow, Garrett & Dunner

[57] ABSTRACT

A silver halide color photographic light-sensitive material is disclosed, which is excellent in color reproducibility and storability and has lowered color stain. The light-sensitive material comprises a support having thereon a silver halide emulsion layer comprising silver halide grains optically sensitized by a sensitizing dye represented Formula I and a sensitizing dye represented by Formula II;

(I)

(II)

5 Claims, No Drawings

SILVER HALIDE COLOR PHOTOGRAPHIC LIGHT-SENSITIVE MATERIAL OFFERING EXCELLENT COLOR REPRODUCTION

FIELD OF THE INVENTION

The present invention relates to a silver halide color photographic light-sensitive material offering improved color reproduction, high sensitivity and good storage stability with little dye staining.

BACKGROUND OF THE INVENTION

Graininess, sharpness and color reproduction are generally recognized as the three major factors which affect image quality of color photography. With the recent marked improvement in image quality of silver halide color photographic light-sensitive materials, the achievements have been almost satisfactory in some markets such as the market for light-sensitive materials for professional use, in which printing is conducted using large formats under strict process management with high precision.

However, in the color light-sensitive materials for ordinary amateurs, image quality remains unsatisfactory when small formats are preferred for operational facility or when high sensitivity light-sensitive materials are selected to lessen photographic load on the user.

Also, in the printing process in said amateur market, basic quality management has been implemented to increase productivity and profitability; uniformity in silver halide color photographic light-sensitive material, including storage stability, immediately affects print quality. It is therefore necessary not only to further improve image quality but also to meet the market requirement of uniform and stable image quality by further improvement.

For improving graininess, a way to quality improvement, reducing the silver halide grain volume is a well-known means, but this is undesirable because it results in sensitivity degradation. Increasing the sensitivity of light-sensitive material grains while retaining the same volume can therefore be related to graininess improving.

Generally, a color light-sensitive material comprises a blue, green and red sensitive units of spectrally sensitized silver halide emulsion. Spectral sensitization dyes tend to significantly affect the sensitivity and color reproducibility of silver halide emulsion and the storage stability of light-sensitive material.

For this reason, a large number of means for sensitizing dyes for color photographic emulsion have been known, including those disclosed in Japanese Patent Examined Publication Nos. 6209/1974, 1569/1980 and 39460/1981 and Japanese Patent Publication Open to Public Inspection (hereinafter referred to as Japanese Patent O.P.I. Publication) Nos. 11419/1974 and 12541/1985, in which the spectral sensitivity distribution is confined within a particular range to prevent color change among picture taking light sources. Moreover, the combination of dyes used in the red- and green-sensitive layers has recently been specified to improve the color reproducibility and storage stability of silver halide color photographic light-sensitive material, as disclosed in Japanese Patent O.P.I. Publication No. 239247/1991.

However, all these conventional methods are accompanied by undesirable dye staining after development. This is a secondary adverse factor of color reproduction deterioration from the viewpoint of suitability to automatic printer which occurs in addition to the primary problem of color reproducibility change.

Moreover, these methods are not sufficient to meet the two requirements of high sensitivity and good color reproduction; there has been a strong demand for the development of a new technology.

SUMMARY OF THE INVENTION

It is an object of the present invention to provide a silver halide color photographic light-sensitive material offering high red sensitivity and improved color reproduction. It is another object of the present invention to provide a silver halide color photographic light-sensitive material having good storage stability with little color staining.

The above objects of the present invention can be accomplished by the following:

A silver halide color photographic light-sensitive material comprising a support and one or more light-sensitive silver halide emulsion layers formed thereon, wherein at least one of said silver halide emulsion layers contains a silver halide grains spectrally sensitized with at least one kind of the sensitizing dye represented by the following formula I and at least one kind of the sensitizing dye represented by the following formula II.

Formula I

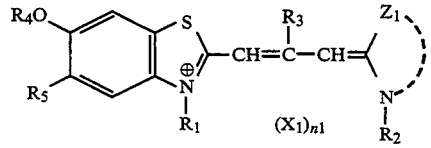

wherein $R_1$ and $R_2$ independently represent an alkyl group having 1 to 10 carbon atoms or an alkenyl group having 3 to 10 carbon atoms; $R_3$ represents a hydrogen atom, an alkyl group, an aryl group or a heterocyclic group; $R_4$ and $R_5$ independently represent an alkyl group.

$Z_1$ represents a group of non-metallic atoms necessary to form a monocyclic or condensed 5-membered nitrogen-containing heterocycle.

$X_1$ represents an ion neutralizing the charge in the molecule; $n_1$ represents the number of ions required to neutralize the charge in the molecule; provided that when the compound forms an intramolecular salt, $n_1$ represents 0.

Formula II

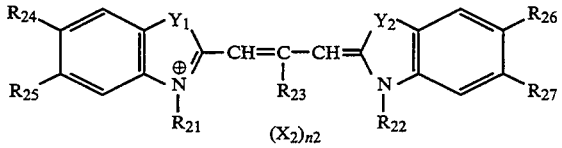

wherein $R_{21}$ and $R_{22}$ independently represent an alkyl group or an aryl group; $R_{23}$ represents a hydrogen atom, an alkyl group, an aryl group or a heterocycle; $R_{24}$ and $R_{26}$ independently represent a hydrogen atom, an alkyl group, an aryl group, a halogen atom, a hydroxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group or a cyano group; $R_{25}$ and $R_{27}$ independently represent a substituent for the above $R_{24}$ or $R_{26}$ or an alkoxy group; $R_{24}$ and $R_{25}$, and $R_{26}$ and $R_{27}$ may bind together to form a ring.

$Y_1$ and $Y_2$ independently represent a sulfur atom or a selenium atom; $X_2$ and $n_2$ have the same definitions as $X_1$ and $n_1$ in formula I.

In the above silver halide color photographic light-sensitive of the invention, it is preferable that the silver halide grains further spectrally sensitized with at a sensitizing dye represented by the following formula III.

Formula III

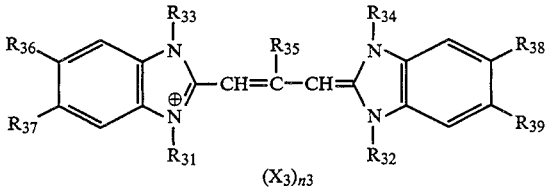

wherein $R_{31}$, $R_{32}$, $R_{33}$ and $R_{34}$ independently represent an alkyl group or an aryl group; $R_{35}$ represents a hydrogen atom, an alkyl group, an aryl group or a heterocyclic group.

$R_{36}$, $R_{37}$, $R_{38}$ and $R_{39}$ independently represent a hydrogen atom, an alkyl group, an aryl group, a halogen atom, a hydroxyl group, an alkoxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group or a cyano group; $R_{36}$ and $R_{37}$, and $R_{38}$ and $R_{39}$ may bind together to form a ring.

$X_3$ and $n_3$ have the same definitions as $X_1$ and $n_1$ in formula I.

DETAILED DESCRIPTION OF THE INVENTION

With respect to the compound represented by formula I for the present invention, $R_1$ and $R_2$ independently represent a branched or linear alkyl group having 1 to 10 carbon atoms such as a methyl group, an ethyl group, a propyl group, a butyl group, a pentyl group, an isopentyl group, a 2-ethylhexyl group, an octyl group or a decyl group, or an alkenyl group having 3 to 10 carbon atoms such as a 2-propenyl group, a 3-butenyl group, a 1-methyl-3-propenyl group, a 3-pentenyl group, a 1-methyl-3-butenyl group or a 4-hexenyl group. These groups may be substituted by a halogen atom such as a fluorine atom, a chlorine atom or a bromine atom, an alkoxy group such as a methoxy group or an ethoxy group, an aryloxy group such as a phenoxy group or a p-tolyloxy group, a cyano group, a carbamoyl group such as a carbamoyl group, an N-methylcarbamoyl group or an N,N-tetramethylenecarbamoyl group, a sulfamoyl group such as a sulfamoyl group or an N,N-3-oxapentamethyleneaminosulfonyl group, a methanesulfonyl group, an alkoxycarbonyl group such as an ethoxycarbonyl group or a butoxycarbonyl group, an aryl group such as a phenyl group or a carboxyphenyl group, an acyl group such as an acetyl group or a benzoyl group, an acylamino group such as an acetylamino group or a benzoylamino group, a sulfonamide group such as a methanesulfonamide group or a butanesulfonamide group, and preferably have a water-solublizing group such as a sulfo group, a carboxyl group, a phosphono group, a sulfato group, a hydroxyl group or a sulfino group. Examples of alkyl groups represented by $R_1$ and $R_2$ as having a water-solublizing substituent include a carboxymethyl group, a sulfoethyl group, a sulfopropyl group, a sulfobutyl group, a sulfopentyl group, a 3-sulfobutyl group, a hydroxyethyl group, a carboxyethyl group, a 3-sulfinobutyl group, a 3-phosphonopropyl group, a p-sulfobenzyl group and an o-carboxybenzyl group. Examples of alkenyl groups having a water-solublizing substituent include a 4-sulfo-3-butenyl group and a 2-carboxyl-2-propenyl group.

Alkyl groups represented by $R_3$, $R_4$ and $R_5$ include linear alkyl groups having 1 to 5 carbon atoms such as a methyl group, an ethyl group, a propyl group, a butyl group, a pentyl group and a hexyl group. Heterocyclic groups represented by $R_3$ include a 2-furyl group, a 2-thienyl group and a 1,3-bis(2-methoxyethyl)-6-hydroxy- 2,4-dioxo-1,2,3,4-tetrahydropyrimidin-5-yl group. Aryl groups represented by $R_3$ include a phenyl group and a naphthyl group. These heterocyclic groups and aryl groups represented by $R_3$ and the alkyl groups represented by $R_3$, $R_4$ and $R_5$ may have a substituent at any position. Example substituents include halogen atoms such as a fluorine atom, a chlorine atom, a bromine atom and an iodine atom, trifluoromethyl groups, substituted or unsubstituted alkoxy groups such as a methoxy group, an ethoxy group, a butoxy group a 2-methoxyethoxy group, a benzyloxy group, hydroxy group, cyano groups, substituted or unsubstituted aryloxy groups such as a phenoxy group, a tolyloxy group, substituted or unsubstituted aryl groups such as a phenyl group, a p-chlorophenyl group, a p-carboxyphenyl group, an o-sulfophenyl group, styryl groups, heterocyclic groups such as a thiazolyl group, a pyridyl group, a furyl group and a thienyl group, carbamoyl groups such as a carbamoyl group and an N-ethylcarbamoyl group, sulfamoyl groups such as a sulfamoyl group and an N,N-dimethylsulfamoyl group, acylamino groups such as an acetylamino group, a propionylamino group and a benzoylamino group, acyl groups such as an acetyl group and a benzoyl group, alkoxycarbonyl groups such as an ethoxycarbonyl group, sulfonamide groups such as a methanesulfonamide group and a benzenesulfonamide group, sulfonyl groups such as a methanesulfonyl group, a butanesulfonyl group and a p-toluenesulfonyl group, sulfo groups, carboxy group, and substituted or unsubstituted alkyl groups such as a methyl group, an ethyl group, an isopropyl group, a methoxyethyl group, a cyanomethyl group, a cyclohexyl group.

The 5-membered or condensed 5-membered nitrogen-containing heterocycle formed by $Z_1$ is exemplified by oxazole rings such as an oxazoline ring, an oxazolidine ring, a benzoxazoline ring, a tetrahydrobenzoxazoline ring and a naphthoxazoline ring, thiazole rings such as a thiazoline ring, a thiazolidine ring, a 1,3,4-thiadiazoline ring, a benzothiazoline ring, a tetrahydrobenzothiazoline ring and a naphthothiazoline ring, selenazole rings such as a selenazoline ring, a selenazolidine ring, a tetrahydrobenzoselenazoline ring, a benzoselenazoline ring and a naphthoselenazoline ring, and imidazole rings such as an imidazoline ring, an imidazolidine ring, a benzimidazoline ring and a naphthoimidazoline ring. These rings may have a substituent at any position. Example substituents include halogen atoms such as a fluorine atom, a chlorine atom, a bromine atom and an iodine atom, unsubstituted or substituted alkoxy groups such as a methoxy group, an ethoxy group, a butoxy group and other unsubstituted alkoxy groups and a 2-methoxyethoxy group, a benzyloxy group, hydroxy group, cyano groups, substituted or unsubstituted aryloxy groups such as a phenoxy group, a tolyloxy group and other substituted or unsubstituted aryloxy groups, aryl groups such as a phenyl group, a p-chlorophenyl group, styryl groups, heterocyclic groups such as a thiazolyl group, a pyridyl group, a furyl group and a thienyl group, carbamoyl groups such as a carbamoyl group and an N-ethylcarbamoyl group, sulfamoyl groups such as a sulfamoyl group and an N,N-dimethylsulfamoyl group, acylamino groups such as an acetylamino group, a propionylamino group and a benzoylamino group, acyl groups such as an acetyl group and a benzoyl group, alkoxycarbonyl groups such as an ethoxycarbonyl group, sulfonamide groups such as a methanesulfonamide group and a benzenesulfonamide group, sulfonyl groups such as a methanesulfonyl group, a butanesulfonyl group and a p-toluenesulfonyl group, carboxy groups, and substituted or unsubstituted alkyl groups such as a methyl group, an ethyl group, an isopropyl group, a methoxyethyl group, a cyanomethyl group, a cyclohexyl group. Methine groups represented by L may be substituted or unsubstituted. Example substituents include substituted or unsubstituted alkyl groups such as a methyl group, an ethyl group, an isobutyl group, a methoxyethyl group, substituted or unsubstituted aryl groups such as a phenyl group, a p-chlorophenyl group, alkoxy groups such as a methoxy group and an ethoxy group and aryloxy groups such as a phenoxy group and a naphthoxy group.

The ion represented by $X^1$, which neutralizes the charge in the molecule, is selected out of anions and cations. The anions, whether organic or inorganic, include halogen ions such as a chlorine ion, a bromine ion and an iodine ion, organic acid anions such as a p-toluenesulfonate ion, a p-chlorobenzenesulfonate ion and a methanesulfonate ion, a tetrafluoroborate ion, a perchlorate ion, a methyl sulfate ion and an ethyl sulfate ion. The cations, whether organic or inorganic, include alkali metal ions such as a lithium ion, a sodium ion, a potassium ion and a strontium ion, alkaline earth metal ions such as a magnesium ion and a calcium ion, an ammonium ion, organic ammonium ions such as a trimethylammonium ion, a triethylammonium ion, a tripropylammonium ion, a triethanolammonium ion and a pyridinium ion.

With respect to formula II, the alkyl group and aryl group for $R_{21}$ and $R_{22}$ are identical with $R_1$ and $R_2$ in formula I; the alkyl group and aryl group for $R_{23}$ are identical with $R_3$ in formula I.

Also, the alkyl groups and aryl groups for $R_{31}$, $R_{32}$, $R_{33}$, $R_{34}$ and $R_{35}$ in formula III are identical with $R_1$ and $R_2$ in formula I.

Preferably, either group of $R_1$ and $R_2$ of the carbocyanine dye represented by formula I is a water-solubilizing group such as a sulfo group, a carboxy group, a hydroxy group or a phosphono group.

The nitrogen-containing heterocycle ring formed by $Z_1$ is preferably an oxazole ring, a thiazole ring, or a condensed ring including oxazole ring or thiazol ring more preferably an oxazole ring or a condensed ring including oxazole ring.

Examples of the sensitizing dyes represented by formulas I, II and III relating to the present invention are given below, which are not to be construed as limitative.

(X)

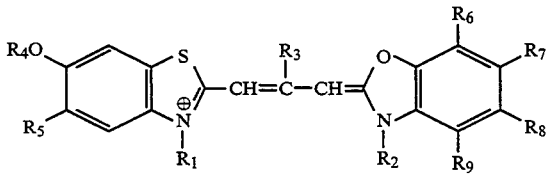

| Example No. | $R_1$ | $R_2$ | $R_3$ | $R_4$ | $R_5$ | $R_6$ | $R_7$ | $R_8$ | $R_9$ | X |
|---|---|---|---|---|---|---|---|---|---|---|
| I-1 | $CH_2COOH$ | $(CH_2)_3SO_3^{\ominus}$ | $C_2H_5$ | $CH_3$ | $CH_3$ | H | H | $C_6H_5$ | H | — |
| I-2 | $(CH_2)_3SO_3^{\ominus}$ | $(CH_2)_4SO_3H$ | $C_2H_5$ | $CH_3$ | $CH_3$ | H | H | Cl | H | $N(C_2H_5)_3$ |
| I-3 | $(CH_2)_4SO_3^{\ominus}$ | $(CH_2)_2SO_3^{\ominus}$ | $C_2H_5$ | $CH_3$ | $CH_3$ | H | H | $C_6H_5$ | H | $Li^{\oplus}$ |
| I-4 | $(CH_2)_2SO_3^{\ominus}$ | $(CH_2)_4SO_3^{\ominus}$ | $C_2H_5$ | $CH_3$ | $CH_3$ | H | H | $OCH_3$ | H | $Li^{\oplus}$ |
| I-5 | *1 | $(CH_2)_4SO_3H$ | $C_2H_5$ | $CH_3$ | $CH_3$ | H | $CH_3$ | Cl | H | $N(C_2H_5)_3$ |
| I-6 | $(CH_2)_4SO_3^{\ominus}$ | $(CH_2)_3SO_3^{\ominus}$ | $C_2H_5$ | $CH_3$ | $CH_3$ | H | H | Cl | H | $Li^{\oplus}$ |
| I-7 | $(CH_2)_4SO_3^{\ominus}$ | $(CH_2)_2OH$ | $CH_3$ | $CH_3$ | $C_2H_5$ | H | $CH_3$ | H | H | — |
| I-8 | $(CH_2)_2SO_3^{\ominus}$ | $(CH_2)_4SO_3H$ | $CH_3$ | $CH_3$ | $CH_3$ | H | H | Cl | H | — |
| I-9 | $CH_2COOH$ | $(CH_2)_4SO_3^{\ominus}$ | $C_3H_7$ | $CH_3$ | $CH_3$ | H | H | $CH_3$ | H | — |
| I-10 | $(CH_2)_4SO_3^{\ominus}$ | $(CH_2)_2SO_3H$ | $C_5H_6$ | $CH_3$ | $CH_3$ | H | H | Cl | H | $N(C_2H_5)_3$ |
| I-11 | $(CH_2)_3SO_3^{\ominus}$ | $(CH_2)_4SO_3^{\ominus}$ | H | $C_3H_7$ | $CH_3$ | H | H | Cl | H | $Li^{\oplus}$ |
| I-12 | $(CH_2)_4SO_3^{\ominus}$ | $(CH_2)_2SO_3H$ | $C_2H_5$ | $CH_3$ | $CH_3$ | H | 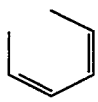 | | H | $N(C_2H_5)_3$ |
| I-13 | $(CH_2)_5SO_3^{\ominus}$ | $CH_3COOH$ | $C_6H_5$ | $C_2H_5$ | $C_2H_5$ | H | H | Cl | H | — |
| I-14 | $(CH_2)_4SO_3^{\ominus}$ | $(CH_2)_2SO_3^{\ominus}$ | $C_2H_5$ | $C_2H_5$ | $CH_3$ | H | Cl | H | H | $Na^{\oplus}$ |
| I-15 | $CH_2COOH$ | $(CH_2)_4SO_3^{\ominus}$ | $C_2H_5$ | $CH_3$ | $CH_3$ | H | H | $C_5H_{11}(t)$ | H | — |
| I-16 | $(CH_2)_2SO_3^{\ominus}$ | $(CH_2)_3SO_3H$ | $C_2H_5$ | $CH_3$ | $CH_3$ | H | H | 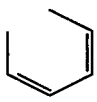 | | $N(C_2H_5)_3$ |

-continued (X)

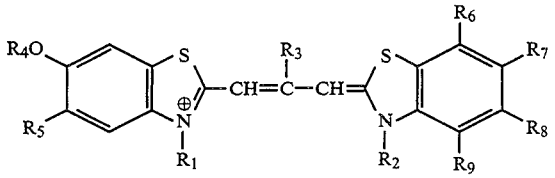

| Example No. | $R_1$ | $R_2$ | $R_3$ | $R_4$ | $R_5$ | $R_6$ | $R_7$ | $R_8$ | $R_9$ | X |
|---|---|---|---|---|---|---|---|---|---|---|
| I-17 | $(CH_2)SO_3^{\ominus}$ | $(CH_2)_4SO_3^{\ominus}$ | $C_2H_5$ | $CH_3$ | $CH_3$ | H | H | Cl | H | Li |
| I-18 | $(CH_2)_4SO_3^{\ominus}$ | $(CH_2)_4SO_3H$ | $C_2H_5$ | $CH_3$ | $CH_3$ | H | H | $OCH_3$ | H | $N(C_2H_5)_3$ |
| I-19 | $(CH_2)_5SO_3^{\ominus}$ | $CH_2COOH$ | $C_2H_5$ | $CH_3$ | $CH_3$ | H | H | $CH_3$ | H | — |
| I-20 | *1 | *2 | $C_2H_5$ | $C_2H_5$ | $CH_3$ | H | H | $C_6H_5$ | H | $N(C_2H_5)_3$ |
| I-21 | $(CH_2)_3SO_3^{\ominus}$ | $(CH_2)_2SO_3H$ | $C_3H_7$ | $CH_3$ | $CH_3$ | H | H | Cl | H | $N(C_2H_5)_3$ |
| I-22 | $(CH_2)_3SO_3^{\ominus}$ | $(CH_2)_3SO_3^{\ominus}$ | $C_2H_5$ | $CH_3$ | $CH_3$ | H | $OCH_3$ | $OCH_3$ | H | $Li^{\oplus}$ |
| I-23 | $(CH_2)_5SO_3^{\ominus}$ | $(CH_2)_5SO_3^{\ominus}$ | $CH_3$ | $CH_3$ | $CH_3$ | H | $OCH_3$ | $OCH_3$ | H | $Na^{\oplus}$ |
| I-24 | $(CH_2)_4SO_3^{\ominus}$ | $(CH_2)_4SO_3H$ | $C_6H_5$ | $CH_3$ | $CH_3$ | H | $OCH_3$ | $OCH_3$ | H | $N(C_2H_5)_3$ |
| I-25 | $CH_2COOH$ | $(CH_2)_4SO_3^{\ominus}$ | $C_2H_5$ | $CH_3$ | $CH_3$ | H | $OCH_3$ | $CH_3$ | H | — |
| I-26 | $(CH_2)_2SO_3^{\ominus}$ | $(CH_2)_2SO_3H$ | $C_2H_5$ | $CH_3$ | $CH_3$ | H | $OCH_3$ | $CH_3$ | H | $N(C_2H_5)_3$ |
| I-27 | $(CH_2)_2SO_3^{\ominus}$ | $(CH_2)_2SO_3^{\ominus}$ | $C_2H_5$ | $C_2H_5$ | $CH_3$ | H | $OC_2H_5$ | $CH_3$ | H | $K^{\oplus}$ |
| I-28 | $CH_2COOH$ | $(CH_2)_2SO_3^{\ominus}$ | $C_2H_5$ | $CH_3$ | $CH_3$ | H | H | Cl | H | — |
| I-29 | $(CH_2)_2SO_3^{\ominus}$ | $(CH_2)_3SO_3^{\ominus}$ | $C_2H_5$ | $CH_3$ | $CH_3$ | H | H | 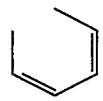 | | $K^{\oplus}$ |
| I-30 | $CH_2COOH$ | $CH_2COO^{\ominus}$ | $-CH_2C_6H_5$ | $C_3H_7$ | $CH_3$ | H | $OC_3H_7$ | $CH_3$ | H | — |
| I-31 | $(CH_2)_4SO_3^{\ominus}$ | $(CH_2)_4SO_3H$ | $CH_3$ | $CH_3$ | $CH_3$ | H | $CH_3$ | $CH_3$ | H | $N(C_2H_5)_3$ |
| I-32 | $(CH_2)_2SO_3^{\ominus}$ | $(CH_2)_2SO_3^{\ominus}$ | $C_6H_5$ | $CH_3$ | $CH_3$ | H | $CH_3$ | H | H | $Li^{\oplus}$ |
| I-33 | $(CH_2)_3SO_3^{\ominus}$ | $(CH_2)_3SO_3H$ | H | $CH_3$ | $CH_3$ | H | $OCH_3$ | $CH_3$ | H | $N(C_2H_5)_3$ |
| I-34 | $(CH_2)_3SO_3^{\ominus}$ | $(CH_2)_3SO_3^{\ominus}$ | *3 | $CH_3$ | $CH_3$ | H | $OCH_3$ | $CH_3$ | H | $Na^{\oplus}$ |
| I-35 | $C_2H_5$ | $C_2H_5$ | *4 | $CH_3$ | $CH_3$ | H | $OCH_3$ | $CH_3$ | H | — |

*1; 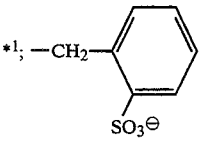

*2; 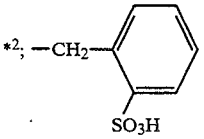

*3; 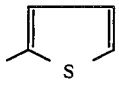

*4; 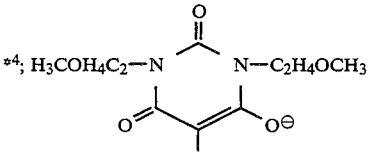

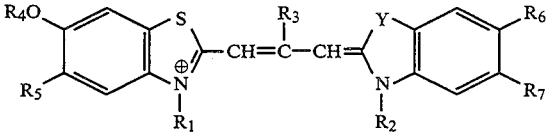

| Example No. | $R_1$ | $R_2$ | $R_3$ | Y | $R_4$ | $R_5$ | $R_6$ | $R_7$ | X |
|---|---|---|---|---|---|---|---|---|---|
| I-36 | $(CH_2)_2SO_3^{\ominus}$ | $(CH_2)_2SO_3H$ | $C_2H_5$ | Se | $CH_3$ | $CH_3$ | H | $CH_3$ | $N(C_2H_5)_3$ |
| I-37 | $CH_2COOH$ | $(CH_2)_4SO_3^{\ominus}$ | $CH_3$ | Se | $CH_3$ | $CH_3$ | H | Cl | — |
| I-38 | $(CH_2)_4SO_3^{\ominus}$ | $(CH_2)_4SO_3^{\ominus}$ | $C_2H_5$ | Se | $CH_3$ | $CH_3$ | H | H | $Li^{\oplus}$ |
| I-39 | $CH_2COOH$ | $(CH_2)_5SO_3^{\ominus}$ | H | Se | $CH_3$ | $CH_3$ | H | H | — |
| I-40 | $(CH_2)_3SO_3^{\ominus}$ | $(CH_2)_3SO_3^{\ominus}$ | $C_2H_5$ | Se | $C_2H_5$ | $CH_3$ | H | $CH_3$ | $Li^{\oplus}$ |

-continued
| | | | | | | | | | |
|---|---|---|---|---|---|---|---|---|---|
| I-41 | $(CH_2)_3SO_3^{\ominus}$ | $(CH_2)_3SO_3^{\ominus}$ | H | $C_2H_5$ —N— | $CH_3$ | $CH_3$ | Cl | Cl | $K^{\oplus}$ |
| I-42 | $CH_2COOH$ | $(CH_2)_2SO_3^{\ominus}$ | H | $C_2H_5$ —N— | $CH_3$ | $CH_3$ | CN | Cl | — |
I-43
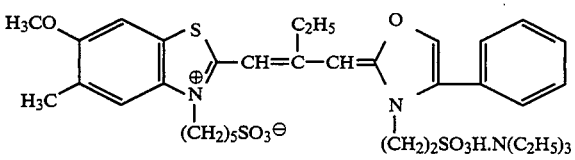
I-44
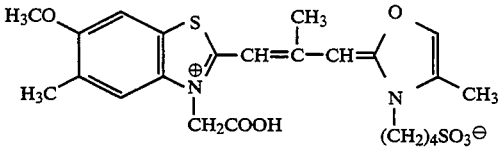
I-45
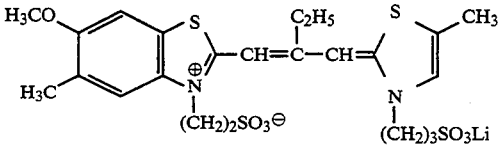
(II-1)
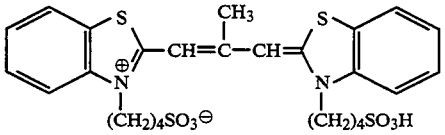
(II-2)
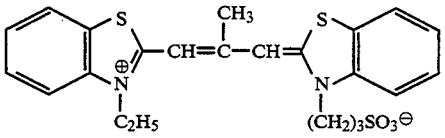
(II-3)
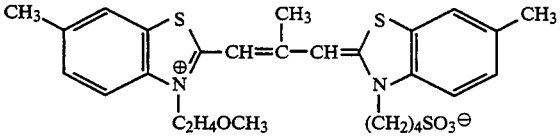
(II-4)
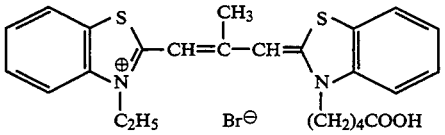
(II-5)
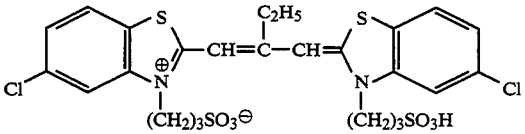
(II-6)
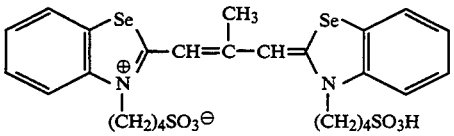

-continued
(II-7)
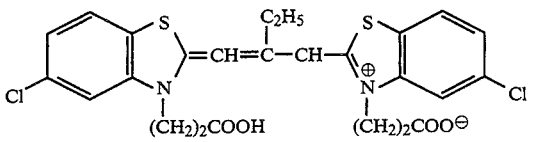
(II-8)
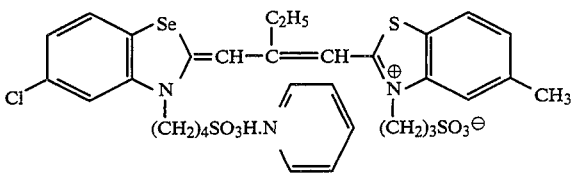
(II-9)
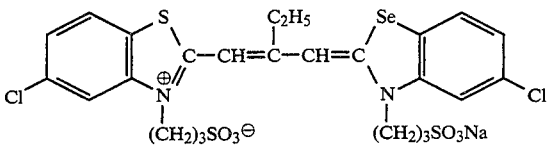
(II-10)
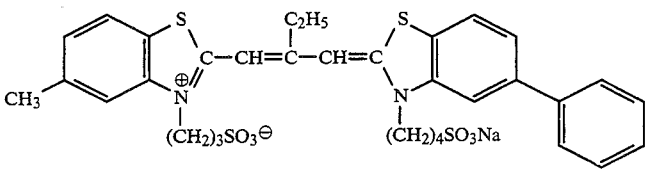
(II-11)
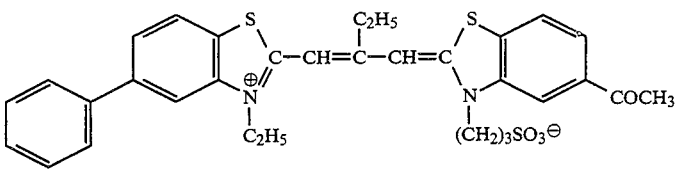
(II-12)
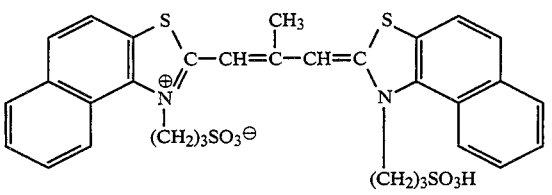
(III-1)
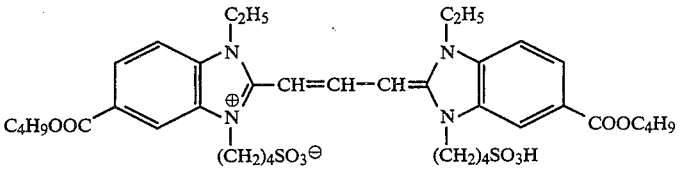
(III-2)
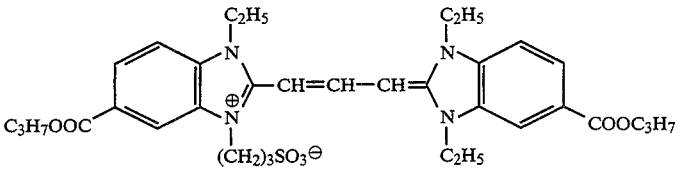
(III-3)
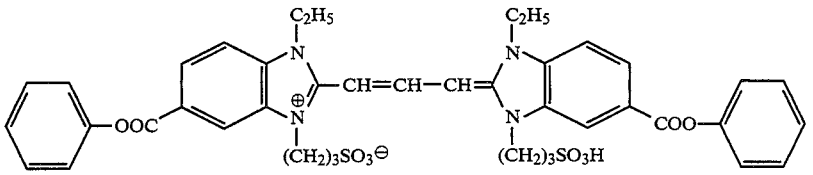

-continued
(III-4)
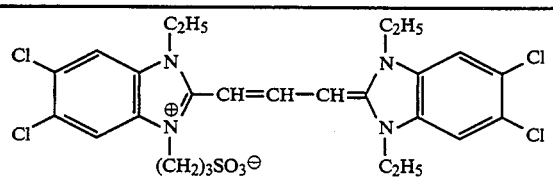
(III-5)
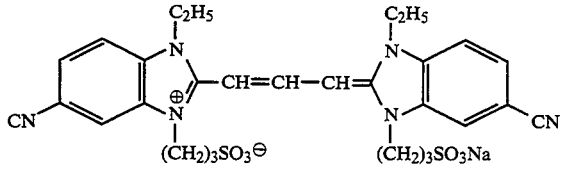
(III-6)
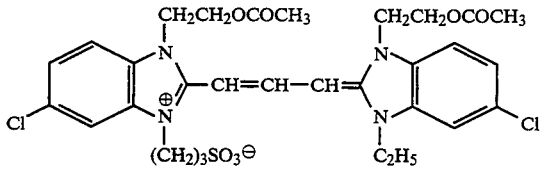
(III-7)
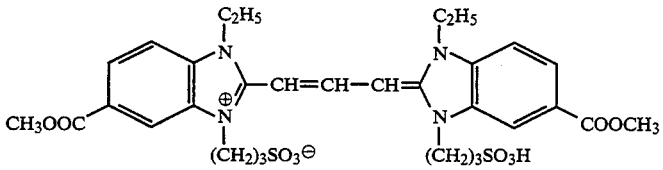
(III-8)
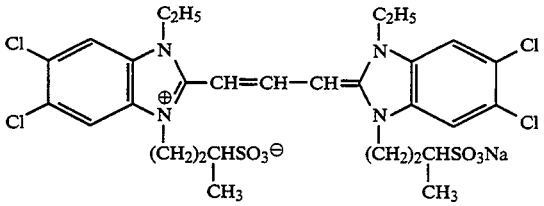
(III-9)
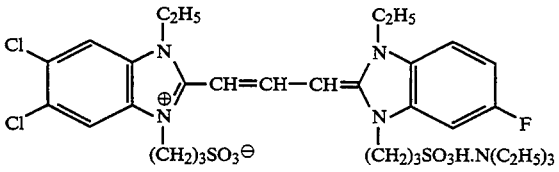
(III-10)
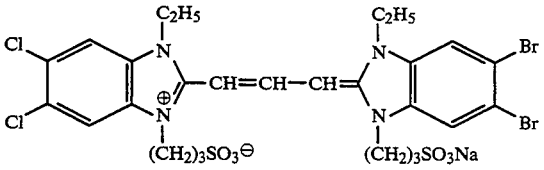
(III-11)
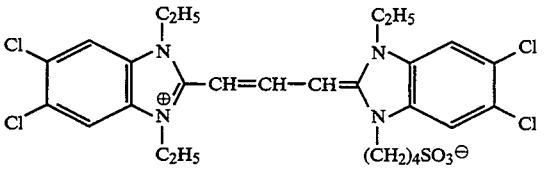
(III-12)
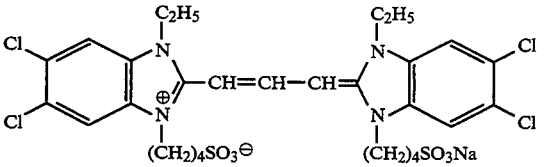
The sensitizing dyes represented by formulas I, II and III relating to the present invention can easily be synthesized by, or in accordance with, the methods described by F. M. Hatmar in Chapters IV, V and VI of "Heterocyclic Compound Cyanine Dyes and Related Compounds", John Wiley & Sons (New York, London) (1964), and by D. M. Sturmer in Chapters VII of "Heterocyclic Compound Special Topics in Heterocyclic Chemistry", John Wiley & Sons (New York, London) (1977).

In the present invention, high spectral sensitization can be achieved by using the sensitizing dyes represented by formulas I, II and III above. Supersensitization is also possible by using supersensitizers such as those described in Japanese Patent Examined Publication Nos. 24533/1982 and 24899/1982 in combination with the sensitizing dyes.

In addition to the above examples, Example Compounds III-5, III-7, III-8 through III-10 and III-15 through III-30 described on pages 42 through 48 of the specification for Japanese Patent O.P.I. Publication No. 239247/1991, filed by the present inventor, can be used as dyes of formula II.

Similarly, Example Compounds I-19 through I-24 and I-29 and I-34 described on pages 25 through 31 of the same specification can be used as dyes of formula III.

As described in Japanese Patent O.P.I. Publication No. 239247/1991, for the purpose of improving color discrepancy among picture taking light sources, typically fluorescent lamps, the spectral red sensitivity distribution $S_R(\lambda)$ can be evaluated as the ratio of the sensitivity at 610 nm $S_R(\lambda=610)$ to the maximum value of spectral sensitivity of the same red-sensitive layer. In this case, the sensitivity at 610 nm is preferably not less than 85%, more preferably not less than 90%.

In the present invention, for the purpose of improving storage stability while maintaining high sensitivity, it is preferable that each silver halide grain in the emulsion layer is a silver halide grain which comprises two or more phases of different silver iodide contents and is also a monodispersed grain having a silver iodide content relative standard deviation of not more than 18%.

The above-mentioned constitution of two or more phases of different silver iodide contents means a core/shell type of silver halide grains comprising a core substantially of a silver iodobromide and a shell of another silver iodobromide differing from the silver iodobromide of the core with regard to silver iodide content. With regard to the silver iodide content of the silver iodobromides forming the core and the shell, it is preferable that the core phase is greater than the shell phase.

Specifically, the core preferably comprises substantially a silver iodobromide containing not less than 5 mol % silver iodide.

These silver halide grains preferably have a double-phase structure in which the core is coated by a shell substantially comprising a silver iodobromide or silver bromide having a silver iodide content lower than that of the core.

The silver iodide content of the core is more preferably not less than 10 mol %, and ideally not less than 20 mol % and not more than 44 mol %. The silver iodide content of the shell is preferably not more than 5 mol %.

The core may uniformly contain silver iodide or may have a multiple-phase structure comprising a number of phases of different silver iodide contents. In the latter case, the silver iodide content of the phase of the highest silver iodide content is preferably not less than 5 mol %, more preferably not less than 10 mol %, and the silver iodide content of the shell is concurrently lower than that of the core's phase of the highest silver iodide content. Also, "to substantially comprise silver iodobromide" means that the composition is based on silver iodide and silver bromide but other components may be contained therein in ratios of up to about 1 mol %, for instance.

In a still more preferred mode of the silver halide grains used in the photographic emulsion layers of the silver halide color photographic light-sensitive material relating to the present invention, the grains have a structure such that when the curve for the ratio of diffraction intensity to diffraction angle on the (220) plane of the silver halide is drawn using Cu and $K\beta$ rays in the diffraction angle ($2\theta$) range from 38° to 42°, there appear two diffraction peaks which correspond to the core and the shell, respectively, with a single diffraction minimum peak therebetween, and that the diffraction intensity for the core is 1/10 to 3/1 of that of the shell. The diffraction intensity ratio is preferably 1/5 to 3/1, more preferably $\frac{1}{3}$ to 3/1.

Such a double-phase structure allows the use of a silver iodobromide emulsion of high silver iodide content without being accompanied by delay of development and hence making possible the obtainment of a light-sensitive material of high sensitivity.

In another preferred mode of embodiment of the silver halide grains contained in the preferred emulsion relating to the present invention, each grain has therein a core-forming silver iodobromide phase of 10 to 40 mol % silver iodide content covered by a shell-forming silver halide phase having a lower silver iodide content and a surface silver iodide content of not less than 5 mol %. The silver iodide composition of the shell may be uniform or not uniform. Here, "a surface silver iodide content of not less than 5 mol %" means that the average silver iodide content of the surface of grain as measured by the X-ray photoelectron spectroscopy method is not less than 5 mol %. Preferably, the average silver iodide content of the surface is not less than 7 mol % and not more than 15 mol %. Such silver halide grains are described in detail in Japanese Patent O.P.I. Publication No. 106745/1988, which are preferable, since they undergo little fogging and offer good graininess.

In still another preferred mode of embodiment of the silver halide grains contained in the preferred emulsion relating to the present invention, each silver halide grain has a core substantially of silver iodobromide and/or silver iodide and a plurality of shells substantially of silver bromide and/or silver iodobromide formed outside the core, the outermost shell contains not more than 10 mol % silver iodide, a high silver iodide shell having a silver iodide content higher by not less than 6 mol % than that of the outermost shell is formed inside the outermost shell, an intermediate shell having an intermediate silver iodide content is formed between the outermost shell and the high silver iodide content shell, the silver iodide content of the intermediate shell is higher by not less than 3 mol % than that of the outermost shell, and the silver iodide content of the high silver iodide shell is higher by not less than 3 mol % than that of the intermediate shell. Such silver halide grains are described in detail in Japanese Patent O.P.I. Publication No. 245151/1986, which are preferable, since they undergo little fogging and offer good graininess.

The preferred emulsion relating to the present invention has a relative standard deviation of silver iodide content of not more than 18% for each silver iodobromide grain, and is preferably uniform with respect to iodide content among grains.

It is also preferable from the viewpoint of uniformity in chemical sensitization and spectral sensitization that the silver iodide content be uniform among silver halide grains.

The silver iodide content of each silver halide grain in the emulsion relating to the present invention and the average silver iodide content of the silver halide grains can be determined by the EPMA (electron probe microanalyzer) method.

In this method, a sample is prepared by thoroughly dispersing emulsion grains apart from each other and making elemental analysis of very small portions of the sample using X-rays excited by electron beam irradiation.

This method allows determination of the halogen composition of each grain by determining the intensities of the silver and iodine characteristic X-rays from each grain.

The average silver iodide of content of the grains of the emulsion can be obtain by averaging values of silver iodide content determined for at least 50 grains by the EPMA method.

The apparatus used for this measurement does not need special specifications. In the examples of the present invention described below, the X-ray microanalyzer JXA-8621, produced by JEOL Ltd., was used to determine the silver iodide content of the emulsion. Measurements were made while cooling the sample to avoid damage by the electron beam.

The relative standard deviation for the silver iodide content of each grain is obtained by multiplying by a factor of 100 the quotient of the standard deviation for the silver iodide content by the average silver iodide content obtained in the measurement on at least 50 emulsion grains.

The preferred emulsion relating to the present invention needs to have a relative standard deviation of not more than 18% with respect to the iodine content distribution among grains as determined by the EPMA method, and, as described above, the silver iodide content of each grain is preferably uniform. Specifically, this value is preferably not more than 15%, and still more preferably not more than 10%.

An emulsion uniform with respect to silver iodide content as described above can be prepared by various means of uniformity improvement, for example, by adjusting silver halide emulsion preparing conditions.

For example, the emulsion preparing method disclosed in Japanese Patent O.P.I. Publication No. 167537/1990, in which fine grains of silver iodide are used to supply iodine ions, and the method disclosed in Japanese Patent O.P.I. Publication No. 183417/1989, in which fine grains of silver iodobromide are grown to seed grains by the Ostwald ripening, are useful.

The silver halide constituting the preferred emulsion relating to the present invention is a silver iodobromide containing not more than 30 mol % silver iodide, preferably a silver iodobromide containing 2 to 20 mol % silver iodide.

For ensuring both high sensitivity and high image quality, it is preferable to raise the average silver iodide content of the silver halide in all emulsion layers to over 8 mol %, as described in Japanese Patent O.P.I. Publication No. 128443/1985. Although raising the average silver iodide content of silver halide is known to markedly improve graininess, silver iodide contents exceeding a particular level pose problems such as of delay of development, desilvering and delay of fixation. The emulsion of the present invention has overcome these problems, making it possible to have high average silver iodide contents.

The preferred light-sensitive silver halide emulsion relating to the present invention is a monodispersed silver halide emulsion.

In the present invention, a monodispersed silver halide emulsion means a silver halide emulsion in which the weight of silver halide grains falling in the grain size range of ±20% of the average grain size d accounts for not less than 70% of the total silver halide weight, preferably not less than 80%, and more preferably not less than 90%.

Here, the average grain size d is defined as the grain size di which gives a maximum value for $ni \times di^3$, wherein di denotes the grain size and ni denotes the number of grains having a diameter of di, significant up to three digits, rounded off at the last digit.

The grain size stated here is the diameter of a circle converted from a grain projection image with the same area.

In the present invention, the twin crystal means a silver halide crystal wherein one or more twin planes are present. The morphological classification of twin crystals are described in detail by Klein and Meuzer in "Photographishe Korrespondenz" Vol 99, p 99 and Vol 100, p 57 Two or more planes of the twin crystal may be parallel or may not be parallel to each other or not.

The silver halide emulsion of the present invention preferably comprises twin crystals of silver halide having two or more parallel twin planes, with further preference given to an even number of twin planes, ideally two twin planes.

In the present invention, "to comprise twin crystals having two or more parallel twin planes" means that the percent ratio by number of twin crystal grains having two or more parallel twin planes is not less than 50%, preferably not less than 60%, and more preferably not less than 70%, as counted in the descending order of grain size.

The twin crystal relating to the present invention may be any one of a twin crystal comprising {111} planes, a twin crystal comprising {100} planes and a twin crystal comprising both of them, but preference is given to a twin crystal comprising {111} planes.

Grain size can be obtained by measuring the diameter of the grain or the area of projected circle on an electron micrograph taken at ×10,000 to 50,000 magnification, the number of subject grains should be not less than 1000 randomly.

A highly monodispersed emulsion preferred for the present invention has a distribution width of not more than 20%, more preferably not more than 15%, defined as follows.

$$(\text{Grain size standard deviation}/\text{average grain size}) \times 100 = \text{distribution broadness } (\%)$$

Here, grain size is measured by the method described above, and average grain size is expressed as arithmetic mean.

$$\text{Average grain size} \times \Sigma dini/\Sigma ni$$

In the present invention, it is preferable that not less than 50% by projected area of the silver halide grains in at least one light-sensitive silver halide emulsion layer is occupied by that of grains having two or more twin planes, since high sensitivity is obtained. The morphological classification of twin Crystals is described in detail by Klein and Meuzer in "Photographishe Korrespondenz" Vol 99, p. 99 and Vol. 100, p.57. Although the two or more planes of the twin crystal may be parallel or not parallel to each other, they are preferably parallel to each other. An even number of twin planes is sufficient, with preference given to a twin crystal having two twin planes.

The preferred twin crystal grain relating to the present invention may be any one of a twin crystal comprising {111} planes, a twin crystal comprising {100} planes and a twin crystal comprising both of them, but preference is given to a twin crystal comprising {111 } planes.

With respect to a twin crystal grain having two or more parallel twin planes, it is preferable that the ratio of the diameter of the circle converted from a projection of the grain at a right angle with respect to the twin planes and the thickness, the distance between two typical grain planes parallel to the parallel twin planes, be not less than 1 and not more than 20, more preferably not less than 1 and less than 5.

The silver halide emulsion for the present invention may be supplemented with a non-gelatin substance exhibiting adsorption to AgX grains at the time of its preparation including preparation of seed emulsion. As such adsorptive substances, compounds or heavy metal ions used as sensitizing dyes, antifogging agents or stabilizers in the photographic industry, for instance, are useful. Examples of such adsorptive substances are given in Japanese Patent O.P.I. Publication No. 7040/1987. It is preferable from the viewpoint of emulsion fogging suppression and storage stability improvement to add at least one kind of antifogging agent and stabilizer among the adsorptive substances at the time of preparation of seed emulsion.

The silver halide emulsion for the present invention may be supplemented with a non-gelatin substance exhibiting adsorption to AgX grains at the time of preparation of the AgX emulsion (including preparation of seed emulsion). As such adsorptive substances, compounds or heavy metal ions used as sensitizing dyes, antifogging agents or stabilizers in the photographic industry, for instance, are useful. Examples of such adsorptive substances are given in Japanese Patent O.P.I. Publication No. 7040/1987. It is preferable from the viewpoint of emulsion fogging suppression and storage stability improvement to add at least one kind of antifogging agent and stabilizer among the adsorptive substances at the time of preparation of seed emulsion.

Of the antifogging agents and stabilizers described above, heterocyclic mercapto compounds and/or azaindene compounds are preferred. Examples of more preferable heterocyclic mercapto compounds and azaindene compounds are described in detail in Japanese Patent O.P.I. Publication No. 41848/1988, which can be used for the present invention.

Although the addition amount of the heterocyclic mercapto compound or azaindene compound is not limited, it is preferably added in a ratio of $1\times10^{-5}$ to $3\times10^{-2}$ mol, more preferably $5\times10^{-5}$ to $3\times10^{-3}$ mol per mol AgX. A proper amount is selected according to AgX grain preparation conditions, average grain size and the type of the compound described above.

The finished emulsion after being provided with a given set of grain properties is desalted by a known method after AgX grain formation. Desalinization can be accomplished by use of a gelatin flocculent, etc. used to desalinize AgX seed grains as described in Japanese Patent O.P.I. Publication Nos. 243936/1988 and 185549/1989, or by the noodle washing method wherein gelatin is gelled, or by the flocculation method utilizing an inorganic polyvalent anionic substance such as sodium sulfate, an anionic surfactant, or an anionic polymer, e. g., polystyrenesulfonic acid.

In the present invention, the silver halide emulsion is physical ripening, chemical ripening and spectral sensitization. Additives used in these processes are described in Research Disclosure Nos. 17643, 18716 and 308119 (hereinafter referred to as RD17643, RD18716 and RD308119, respectively).

Known photographic additives which can be used for the present invention are also specified in the above Research Disclosures.

Various couplers can be used for the present invention. Examples thereof are described in the above Research Disclosures.

In the present invention, the red-sensitive layer contains a cyan coupler, preferably a naphthol- or phenol-based coupler.

The green-sensitive layer contains a magenta coupler. Magenta couplers preferably used are known 5-pyrazolone couplers, pyrazolobenzimidazole couplers, pyrazolotriazole couplers and open-chain acylacetonitrile couplers.

The blue-sensitive layer contains a yellow coupler. Yellow couplers preferably used include acylacetoanilide couplers, with greater preference given to benzoylacetoanilide compounds and pivaloylacetoanilide compounds.

The light-sensitive material of the present invention can be developed by the ordinary methods described in the above-mentioned RD 17643, pp. 28–29, RD18716, p. 647 and RD308119, XVII.

EXAMPLES

In all examples given below, the amount of addition in silver halide photographic light-sensitive material is described in grams per $m^2$, unless otherwise stated. The figures for silver halide and colloidal silver have been converted to the amount of silver. Figures for the amount of sensitizing dyes are shown in mol per mol of silver in the same layer.

EXAMPLE 1

Layers with the following compositions were formed on a triacetyl cellulose film support in this order from the support side to yield multiple-layer color photographic light-sensitive material sample No. 101.

| Sample No. 101 | |
|---|---|
| Silver iodobromide emulsion Em-A | 2.5 |
| Sensitizing dye SR-1 | $2.5\times10^{-4}$ |
| Sensitizing dye II-5 | $2.5\times10^{-4}$ |
| Sensitizing dye II-12 | $2.0\times10^{-5}$ |
| Gelatin | 5.0 |

In addition to these compositions, a coating aid, a stabilizer and a hardener were added. Em-A was optimally chemically ripened with sodium thiosulfate, chloroauric acid and ammonium thiocyanic acid. Next, sample Nos. 102 through 116 were prepared in the same manner as with sample No. 101 except that sensitizing dye SR-1 and silver iodobromide emulsion Em-A were replaced with a sensitizing dye and emulsion shown in Table 2. The silver halide emulsions used to prepare sample Nos. 101 through 116 are as follows:

TABLE 1

| Emulsion | Average grain size (μm) | Grain size distribution (%) | Silver iodide distribution (%) | Silver iodide content (average) | Silver iodide content (outermost phase) | Grain shape | Remark |
|---|---|---|---|---|---|---|---|
| Em-A | 0.65 | 14 | 22 | 7.5 | Not added | Octahedral | Uniform composition |
| Em-1 | 0.65 | 14 | 18 | 7.5 | 0.5 | Octahedral | — |
| Em-2 | 0.65 | 12 | 12 | 7.5 | 0.3 | Octahedral | — |

Each obtained sample was cut into strips and subjected to white light exposure through an optical wedge and a yellow filter. After exposure, each strip was developed with a developer of the following composition at 20° C. for 3 minutes and then subjected to stopping, fixing, washing and drying processes to yield strips having a desired black-and-white image.

Developer composition

| | |
|---|---|
| Metol | 2.0 g |
| Anhydrous sodium sulfite | 40 g |
| Hydroquinone | 4 g |
| Sodium carbonate monohydrate | 28 g |

Water was added to make a total quantity of 1 liter.

The sample thus obtained was subjected to densitometry using an optical densitometer, and the sensitivity and fogging were evaluated.

The point corresponding to a fogging level of +0.20 was used as the basis for optical density for the sensitivity determination. Separately, coated sample Nos. 101 through 116 (not processed with the developer) were processed with a fixer to remove all the silver content, after which the color density of each strip was determined, and dye staining was evaluated on the basis of the maximum value of the thus-determined spectral density.

The results are given in Table 2.

Figures for sensitivity are shown as percent ratio relative to the sensitivity of sample No. 101.

TABLE 2

| Sample No. | Sensitizing dye ($\times 10^{-4}$ mol/mol silver) | Silver halide | Sensitivity | Fogging | Dye staining density | Remark |
|---|---|---|---|---|---|---|
| 101 | SR-1 2.5 | Em-A | 100 | 0.06 | 0.08 | Comparative |
| 102 | SR-2 2.5 | Em-A | 106 | 0.05 | 0.06 | Comparative |
| 103 | SR-3 2.5 | EM-A | 108 | 0.05 | 0.06 | Comparative |
| 104 | SR-4 2.5 | EM-A | 108 | 0.06 | 0.04 | Comparative |
| 105 | SR-5 2.0 | Em-A | 110 | 0.07 | 0.04 | Comparative |
| 106 | SR-6 2.5 | Em-A | 108 | 0.06 | 0.04 | Comparative |
| 107 | I-6 2.5 | EM-A | 126 | 0.04 | 0.01 | Inventive |
| 108 | I-3 2.5 | EM-A | 122 | 0.02 | 0.02 | Inventive |
| 109 | I-1 2.5 | Em-A | 125 | 0.04 | 0.02 | Inventive |
| 110 | I-21 2.0 | Em-A | 128 | 0.04 | 0.01 | Inventive |
| 111 | I-6 1.3<br>III-5 1.2 | Em-A | 126 | 0.04 | 0.01 | Inventive |
| 112 | I-3 1.3<br>III-6 1.2 | Em-A | 126 | 0.04 | 0.01 | Inventive |
| 113 | I-1 1.3<br>III-5 1.2 | Em-A | 130 | 0.04 | 0.01 | Inventive |
| 114 | I-6 2.5 | Em-1 | 140 | 0.02 | 0.01 | Inventive |
| 115 | I-6 2.5 | Em-2 | 154 | 0.02 | 0.02 | Inventive |
| 116 | I-6 1.3<br>III-5 1.2 | Em-2 | 142 | 0.02 | 0.01 | Inventive |

Note: The listed sensitizing dyes are those which are added in place of SR-1 of sample No. 101; figures for the amount of addition are shown in the same column.

As seen in Table 2, sample Nos. 107 through 116, all of which were prepared with a combination of sensitizing dyes relating to the present invention, offered high sensitivity and underwent suppressed fogging and very low dye staining. Sample Nos. 114 through 116, all of which incorporated the silver halide emulsion Em-1 or Em-2, were found to have very low fogging and excellent sensitivity.

Dyes used for comparison

SR-1

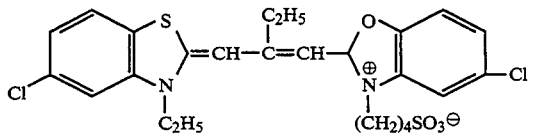

(Described in Japanese Patent O.P.I. Publication No. 239247/1991.)

-continued

SR-2

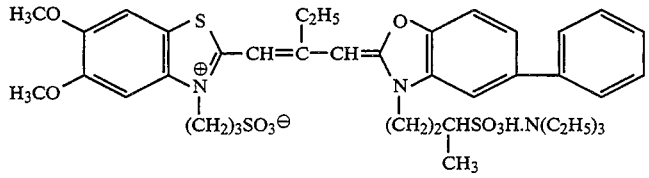

(Described in U.S. Pat. No. 4,326,023.)

SR-3

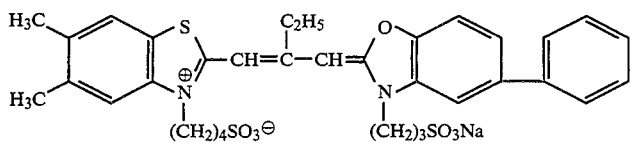

(Described in Japanese Patent O.P.I. Publication No. 28283/1986.)

SR-4

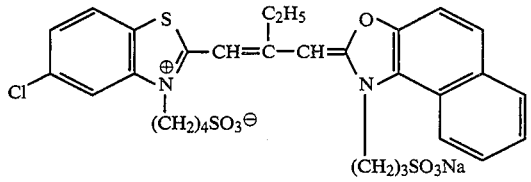

(Described in Japanese Patent O.P.I. Publication No. 28283/1986.)

SR-5

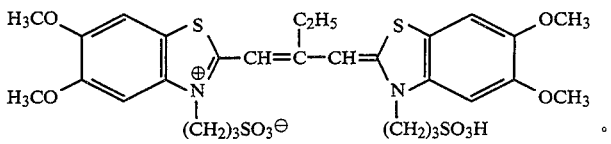

(Described in Japanese Patent O.P.I. Publication No. 62355/1987.)

SR-6

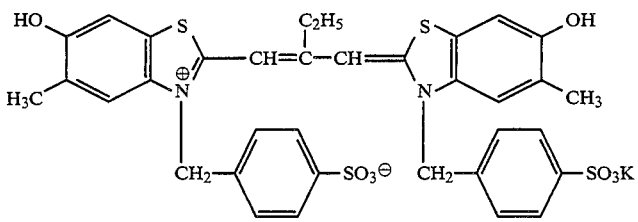

(Described in Japanese Patent O.P.I. Publication No. 62355/1987.)

EXAMPLE 2

Layers of the following compositions were formed on a triacetyl cellulose film support in this order from the support side to yield multiple-layer color photographic light-sensitive material sample No. 201.

| Sample No. 201 | |
|---|---|
| Layer 1: Anti-halation layer | |
| Black colloidal silver | 0.16 |
| UV absorbent UV-1 | 0.20 |
| High boiling solvent Oil-1 | 0.16 |
| Gelatin | 1.23 |
| Layer 2: Intermediate layer | |
| High boiling solvent Oil-2 | 0.17 |
| Gelatin | 1.27 |
| Layer 3: Low speed red-sensitive emulsion layer | |
| Silver iodobromide emulsion Em-B | 0.50 |
| Sensitizing dye II-5 | $2.8 \times 10^{-5}$ |
| Sensitizing dye SR-1 | $2.9 \times 10^{-4}$ |
| Sensitizing dye II-12 | $1.9 \times 10^{-4}$ |
| Cyan coupler C-1 | 0.48 |
| Cyan coupler C-2 | 0.14 |
| Colored cyan coupler CC-1 | 0.021 |

-continued

| Sample No. 201 | |
|---|---|
| DIR compound D-1 | 0.020 |
| High boiling solvent Oil-1 | 0.53 |
| Gelatin | 1.30 |
| Layer 4: Moderate speed red-sensitive emulsion layer | |
| Silver iodobromide emulsion Em-C | 0.62 |
| Sensitizing dye II-5 | $2.3 \times 10^{-4}$ |
| Sensitizing dye SR-1 | $2.4 \times 10^{-4}$ |
| Sensitizing dye II-12 | $1.6 \times 10^{-5}$ |
| Cyan coupler C-1 | 0.15 |
| Cyan coupler C-2 | 0.18 |
| Colored cyan coupler CC-1 | 0.030 |
| DIR compound D-1 | 0.013 |
| High boiling solvent Oil-1 | 0.30 |
| Gelatin | 0.93 |
| Layer 5: High speed red-sensitive emulsion layer | |
| Silver iodobromide emulsion Em-D | 1.27 |
| Sensitizing dye II-5 | $1.3 \times 10^{-4}$ |
| Sensitizing dye SR-1 | $1.3 \times 10^{-4}$ |
| Sensitizing dye II-12 | $1.6 \times 10^{-4}$ |
| Cyan coupler C-2 | 0.12 |
| Colored cyan coupler CC-1 | 0.013 |
| High boiling solvent Oil-1 | 0.14 |
| Gelatin | 0.91 |

-continued

| Sample No. 201 | |
|---|---|
| Layer 6: Intermediate layer | |
| High boiling solvent Oil-2 | 0.11 |
| Gelatin | 0.80 |
| Layer 7: Low speed green-sensitive emulsion layer | |
| Silver iodobromide emulsion (average grain size 0.38 μm, silver iodide content 8.0 mol %) | 0.61 |
| Silver iodobromide emulsion (average grain size 0.27 μm, silver iodide content 2.0 mol %) | 0.20 |
| Sensitizing dye III-5 | $7.4 \times 10^{-5}$ |
| Sensitizing dye SD-1 | $6.6 \times 10^{-4}$ |
| Magenta coupler M-1 | 0.18 |
| Magenta coupler M-2 | 0.44 |
| Colored magenta coupler CM-1 | 0.75 |
| High boiling solvent Oil-2 | 0.75 |
| Gelatin | 1.95 |
| Layer 8: Moderate speed green-sensitive emulsion layer | |
| Silver iodobromide emulsion (average grain size 0.50 μm, silver iodide content 8.0 mol %) | 0.87 |
| Sensitizing dye SD-2 | $2.4 \times 10^{-4}$ |
| Sensitizing dye SD-3 | $2.4 \times 10^{-4}$ |
| Magenta coupler M-1 | 0.058 |
| Magenta coupler M-2 | 0.13 |
| Colored magenta coupler CM-1 | 0.070 |
| DIR compound D-2 | 0.025 |
| DIR compound D-3 | 0.002 |
| High boiling solvent Oil-2 | 0.50 |
| Gelatin | 1.00 |
| Layer 9: High speed green-sensitive emulsion layer | |
| Silver iodobromide emulsion (average grain size 1.00 μm, silver iodide content 8.0 mol %) | 1.27 |
| Sensitizing dye SD-2 | $1.4 \times 10^{-4}$ |
| Sensitizing dye SD-3 | $1.4 \times 10^{-4}$ |
| Magenta coupler M-2 | 0.084 |
| Magenta coupler M-3 | 0.064 |
| Colored magenta coupler CM-1 | 0.012 |
| High boiling solvent Oil-1 | 0.27 |
| High boiling solvent Oil-2 | 0.12 |
| Gelatin | 1.00 |
| Layer 10: Yellow filter layer | |
| Yellow colloidal silver | 0.08 |
| Anti-color staining agent SC-2 | 0.15 |
| Formalin scavenger HS-1 | 0.20 |
| High boiling solvent Oil-2 | 0.19 |
| Gelatin | 1.10 |
| Layer 11: Intermediate layer | |
| Formalin scavenger HS-1 | 0.20 |
| Gelatin | 0.60 |
| Layer 12: Low speed blue-sensitive emulsion layer | |
| Silver iodobromide emulsion (average grain size 0.38 μm, silver iodide content 5.0 mol %) | 0.22 |

-continued

| Sample No. 201 | |
|---|---|
| Silver iodobromide emulsion (average grain size 0.27 μm, silver iodide content 2.0 mol %) | 0.03 |
| Sensitizing dye SD-4 | $4.9 \times 10^{-4}$ |
| Yellow coupler Y-1 | 0.75 |
| DIR compound D-1 | 0.010 |
| High boiling solvent Oil-2 | 0.30 |
| Gelatin | 1.20 |
| Layer 13: Moderate speed blue-sensitive emulsion layer | |
| Silver iodobromide emulsion (average grain size 0.59 μm, silver iodide content 8.0 mol %) | 0.30 |
| Sensitizing dye SD-4 | $1.6 \times 10^{-4}$ |
| Sensitizing dye SD-5 | $7.2 \times 10^{-5}$ |
| Yellow coupler Y-1 | 0.10 |
| DIR compound D-1 | 0.010 |
| High boiling solvent Oil-2 | 0.046 |
| Gelatin | 0.47 |
| Layer 14: High speed blue-sensitive emulsion layer | |
| Silver iodobromide emulsion (average grain size 1.00 μm, silver iodide content 1.00 mol %) | 0.85 |
| Sensitizing dye SD-4 | $7.3 \times 10^{-5}$ |
| Sensitizing dye SD-5 | $2.8 \times 10^{-5}$ |
| Yellow coupler Y-1 | 0.11 |
| High boiling solvent Oil-2 | 0.046 |
| Gelatin | 0.80 |
| Layer 15: First protective layer | |
| Silver iodobromide emulsion (average grain size 0.08 μm, silver iodide content 1.00 mol %) | 0.40 |
| UV absorbent UV-1 | 0.065 |
| UV absorbent UV-2 | 0.10 |
| High boiling solvent Oil-1 | 0.07 |
| High boiling solvent Oil-3 | 0.07 |
| Formalin scavenger HS-1 | 0.40 |
| Gelatin | 1.31 |
| Layer 16: Second protective layer | |
| Akali-soluble matting agent (average grain size 2 μm) | 0.15 |
| Polymethyl methacrylate (average grain size 3 μm) | 0.04 |
| Lubricant WAX-1 | 0.04 |
| Gelatin | 0.55 |

In addition to these compositions, a coating aid Su-1, a dispersing agent Su-2, a viscosity regulator, hardeners H-1 and H-2, a stabilizer ST-1, an antifogging agent AF-1 and two kinds of AF-2 having an average molecular weight of 10,000 or 1,100,000, respectively, and an antiseptic DI-1 were added to appropriate layers in a total amount of 9.4 mg/m$^2$.

C-1

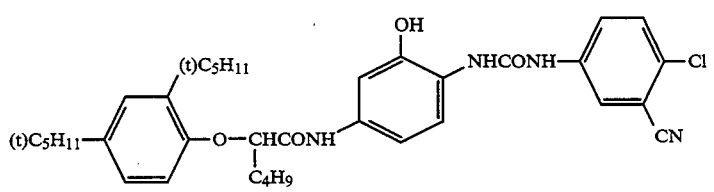

C-2

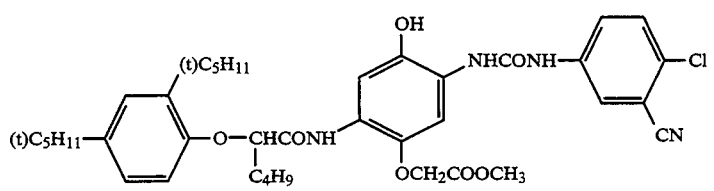

-continued
M-1
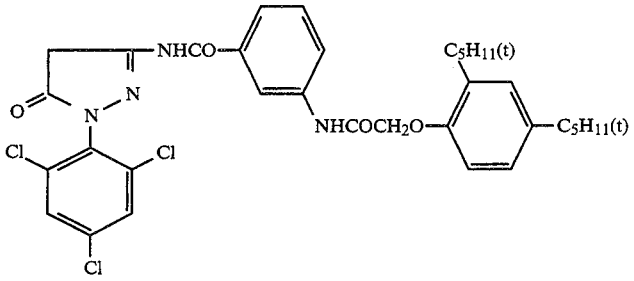
M-2
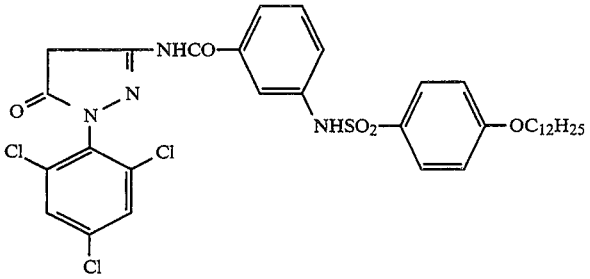
M-3
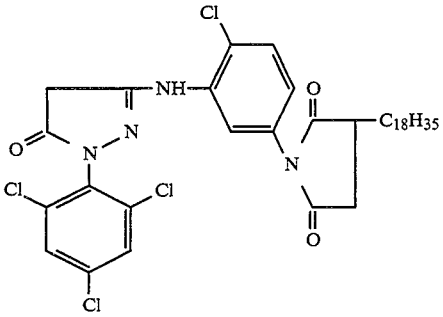
Y-1
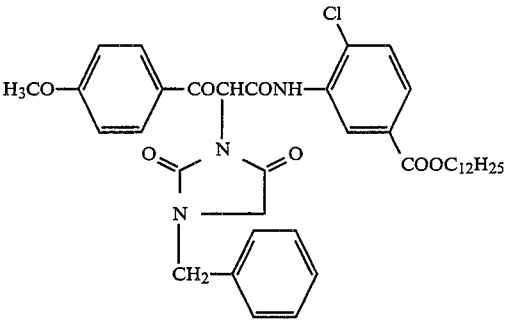
CC-1
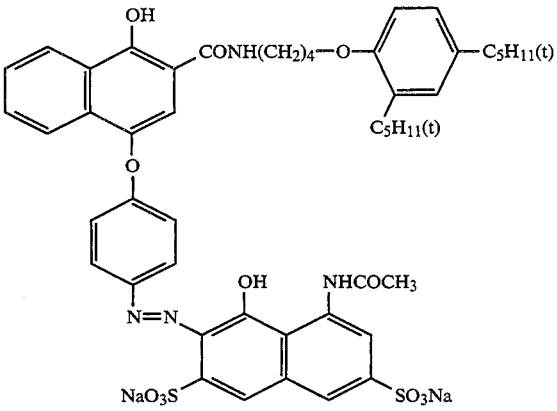

-continued
CM-1
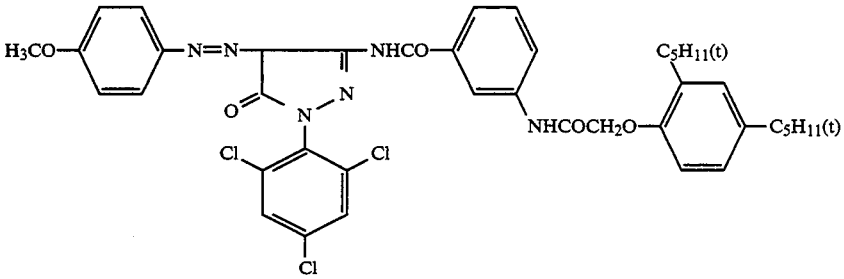
D-1
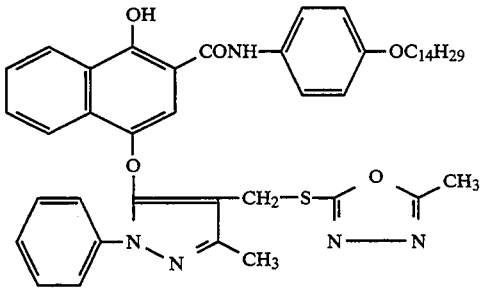
D-2
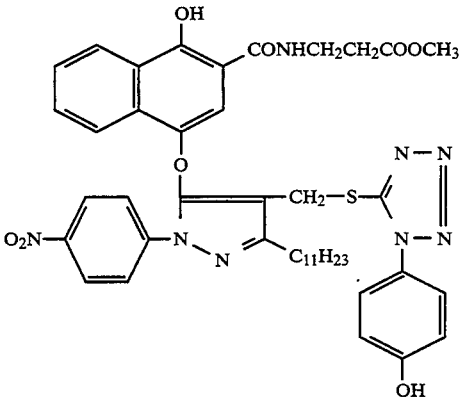
D-3
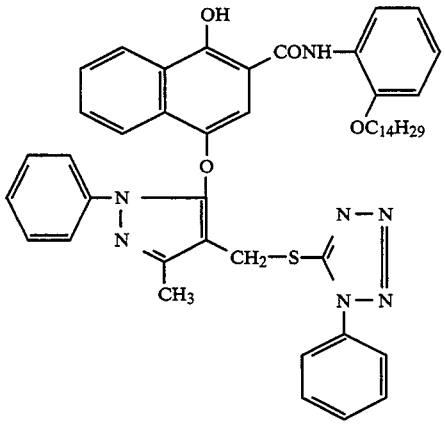
Oil-1
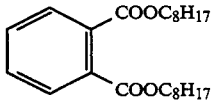
Oil-2
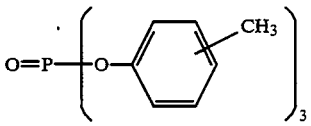

-continued
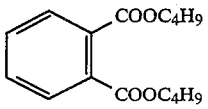
Oil-3
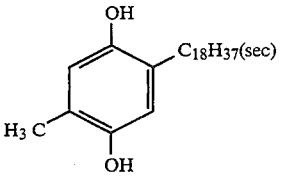
SC-2
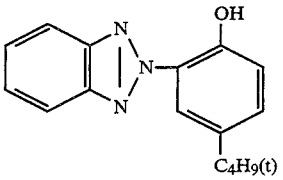
UV-1
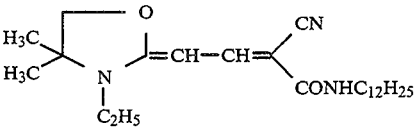
UV-2
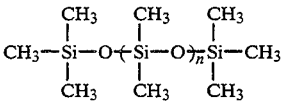
Weight-average molecular weight Mw = 3,000
WAX-1
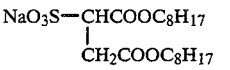
Su-1
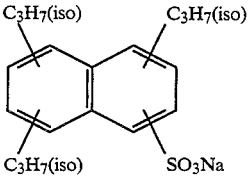
Su-2
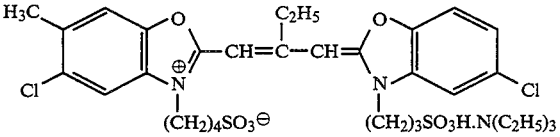
SD-1
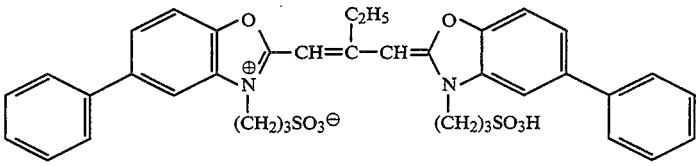
SD-2
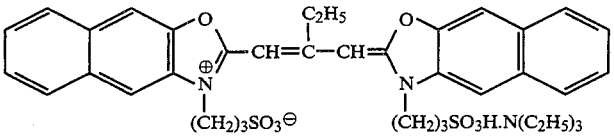
SD-3

-continued

SD-4

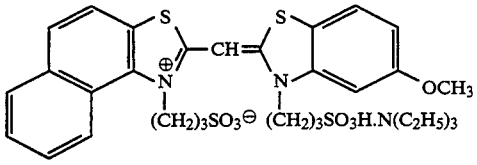

SD-5

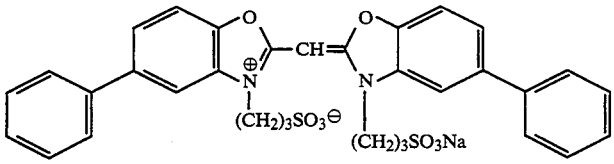

H-1

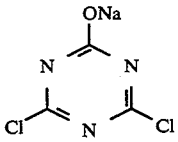

H-2

$(CH_2{=}CHSO_2CH_2)_2O$

ST-1

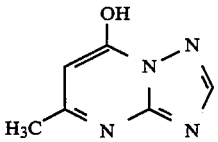

AF-1

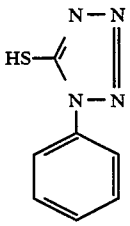

AF-2

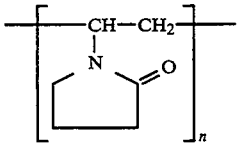

n: Degree of polymerization

DI-1

Component A

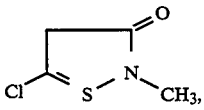

Component B

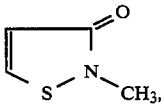

Component C

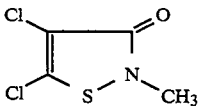

Components A:B:C = 50:46:4 (molar ratio)

Next, sample Nos. 202 through 215 were prepared in the same manner as sample No. 201 except that the emulsions and sensitizing dye SR-1 for layers 3, 4 and 5 were replaced as shown in Table 4 below. Details of the silver halide emulsions used to prepare sample Nos. 201 through 215 are given in Table 3.

TABLE 3

| | Silver iodide content | | | | | | | |
|---|---|---|---|---|---|---|---|---|
| Emulsion | Average AgI (%) | Inner phase AgI (%) | Intermediate phase AgI (%) | Outermost phase AgI (%) | Relative standard deviation (%) | Average grain size (μm) | Grain shape | Remark |
| Em-B | 8.0 | — | — | — | 26 | 0.40 | Tetradecahedral | Uniform composition |
| Em-C | 8.0 | — | — | — | 25 | 0.55 | Octahedral | Uniform composition |
| Em-D | 8.0 | — | — | — | 25 | 1.00 | Octahedral | Uniform composition |

TABLE 3-continued

| Emulsion | Silver iodide content: Average AgI (%) | Inner phase AgI (%) | Intermediate phase AgI (%) | Outermost phase AgI (%) | Relative standard deviation (%) | Average grain size (μm) | Grain shape | Remark |
|---|---|---|---|---|---|---|---|---|
| Em-3 | 8.0 | 32 | 15 | 1 | 17 | 0.35 | Tetradecahedral | — |
| Em-4 | 8.1 | 40 | 15 | 1 | 16 | 0.55 | Octahedral | — |
| Em-5 | 8.3 | 40 | 15 | 1 | 16 | 1.00 | Octahedral | — |
| Em-6 | 8.0 | 35 | — | 1 | 13 | 0.55 | Octahedral | — |
| Em-7 | 8.0 | 35 | — | 1 | 12 | 1.0 | Octahedral | — |
| Em-8 | 8.0 | 35 | — | 1 | 9 | 1.0 | Octahedral | Twin crystal with two twin planes |

TABLE 4

| Sample No. | Layer 3 (low-speed red-sensitive emulsion layer): Emulsion | Dye | Amount of addition | Layer 4 (moderate-speed red-sensitive emulsion layer): Emulsion | Dye | Amount of addition | Layer 5 (high-speed red-sensitive emulsion layer): Emulsion | Dye | Amount of addition |
|---|---|---|---|---|---|---|---|---|---|
| 201 | Em-B | SR-1 | 2.9 | Em-C | SR-1 | 2.4 | Em-D | SR-1 | 1.3 |
| 202 | Em-B | SR-2 | 2.9 | Em-C | SR-2 | 2.4 | Em-D | SR-2 | 1.3 |
| 203 | Em-B | SR-3 | 2.9 | Em-C | SR-3 | 2.4 | Em-D | SR-3 | 1.3 |
| 204 | Em-B | SR-4 | 2.9 | Em-C | SR-4 | 2.4 | EM-D | SR-4 | 1.3 |
| 205 | Em-B | SR-5 | 2.4 | Em-C | SR-5 | 2.0 | Em-D | SR-5 | 1.1 |
| 206 | Em-B | I-6 | 2.9 | Em-C | I-6 | 2.4 | Em-D | I-6 | 1.3 |
| 207 | Em-B | I-3 | 2.9 | Em-C | I-3 | 2.4 | Em-D | I-3 | 1.3 |
| 208 | Em-B | I-21 | 2.9 | Em-C | I-21 | 2.4 | Em-D | I-21 | 1.3 |
| 209 | Em-B | I-6 | 1.5 | Em-C | I-6 | 1.2 | EM-D | I-6 | 0.7 |
| | Em-B | III-5 | 1.4 | | III-5 | 1.2 | Em-D | II-5 | 0.6 |
| 210 | Em-B | I-3 | 1.5 | Em-C | I-3 | 1.2 | Em-D | I-3 | 0.7 |
| | Em-B | III-6 | 1.4 | | III-6 | 1.2 | Em-D | III-6 | 0.6 |
| 211 | Em-3 | I-6 | 2.9 | Em-4 | I-6 | 2.4 | Em-5 | I-6 | 1.3 |
| 212 | Em-3 | I-3 | 2.9 | Em-4 | I-3 | 2.4 | Em-5 | I-3 | 1.3 |
| 213 | Em-3 | I-6 | 2.9 | Em-6 | I-6 | 2.4 | Em-7 | I-6 | 1.3 |
| 214 | Em-3 | I-6 | 2.9 | Em-6 | I-6 | 2.4 | Em-8 | I-6 | 1.3 |
| 215 | Em-3 | I-6 | 1.5 | Em-4 | I-6 | 1.2 | Em-5 | I-6 | 0.7 |
| | Em-3 | III-5 | 1.4 | Em-4 | III-5 | 1.2 | Em-5 | III-5 | 0.6 |

(Figures for the amount of dye added are expressed as $\times 10^{-4}$ mol/mol AgX.)

Each obtained sample was cut into strips and then subjected to white light exposure through an optical wedge and processed as described below. The developed sample was subjected to sensitometry. Figures for sensitivity are expressed as percent ratios relative to the sensitivity of sample No. 201. To evaluate the storage stability of the light-sensitive material, sample Nos. 201 through 215 were stored at a temperature of 40° C. and a relative humidity of 60% for 7 days, after which each sample was subjected to white light exposure through an optical wedge, developed and then evaluated as to fogging and sensitivity. In this case as well, figures for sensitivity are expressed as percent ratios relative to the sensitivity of sample No. 201 as kept fresh. The results are shown in Table 5.

TABLE 5

| Sample No. | Red-sensitive emulsion layer photographic performance: Before storage: Sensitivity | Fogging | After 7-day storage at 40° C., 60% RH: Sensitivity | Fogging | Remark |
|---|---|---|---|---|---|
| 201 | 100 | 0.23 | 90 | 0.33 | Comparative |
| 202 | 106 | 0.24 | 92 | 0.32 | Comparative |
| 203 | 107 | 0.23 | 94 | 0.32 | Comparative |
| 204 | 108 | 0.23 | 94 | 0.30 | Comparative |
| 205 | 110 | 0.22 | 90 | 0.30 | Comaprative |
| 206 | 126 | 0.20 | 119 | 0.21 | Inventive |
| 207 | 124 | 0.19 | 122 | 0.20 | Inventive |
| 208 | 125 | 0.19 | 120 | 0.20 | Inventive |
| 209 | 128 | 0.20 | 120 | 0.22 | Inventive |
| 210 | 126 | 0.20 | 119 | 0.22 | Inventive |
| 211 | 138 | 0.17 | 135 | 0.20 | Inventive |

TABLE 5-continued

| Sample No. | Red-sensitive emulsion layer photographic performance: Before storage: Sensitivity | Fogging | After 7-day storage at 40° C., 60% RH: Sensitivity | Fogging | Remark |
|---|---|---|---|---|---|
| 212 | 136 | 0.17 | 135 | 0.20 | Inventive |
| 213 | 150 | 0.13 | 148 | 0.14 | Inventive |
| 214 | 155 | 0.16 | 150 | 0.17 | Inventive |
| 215 | 140 | 0.18 | 140 | 0.20 | Inventive |

As seen in Table 5, sample Nos. 206 through 215, all of which were prepared with a combination of sensitizing dyes relating to the present invention, had low fogging and high sensitivity and exhibited stable photographic performance in the storage stability test. In sample Nos. 211 through 215, all of which were prepared from silver halide grains having a multiple-phase silver iodide distribution, sensitivity was particularly high and fogging was very low.

EXAMPLE 3

With respect to sample Nos. 210 through 215 prepared in Example 2, the spectral sensitivity distribution at a minimum density of +0.3 was determined. The ratio of the sensitivity at 610 nm of the red-sensitive emulsion layer to the sensitivity at the wavelength for the maximum sensitivity in the same layer ($\lambda R_{max}$) was calculated. Also, sample Nos. 210 through 215 were shaped to allow their loading in a camera, after which portrait pictures of a woman were taken under daytime outdoor conditions and under indoor fluorescent lamp lighting conditions. The image obtained was printed on color printing paper under such conditions that the former outdoor scene would be reproduced with a naturalistic color tone, and the overall color tone of the latter indoor scene would be visually evaluated. With respect to color tone, the samples were evaluated as follows:

A: Color tone almost the same as with the outdoor scene.

B: Although generally greenish, no problem.

C: The woman's skin is reproduced partially greenish.

D: Generally green, inappreciable.

The results are shown in Table 6. As is evident from Table 6, sample Nos. 206 through 215, all of which were prepared in accordance with the present invention, had improved the drawback of generally greenish color tone, in comparison with the comparative sample.

Also, with respect to sample Nos. 209, 210 and 215, in all of which the ratio of the sensitivity at 610 nm of the red-sensitive emulsion layer to the maximum density was not less than 85%, the improving effect was marked and the color tone obtained was comparable to that obtained with the outdoor scene.

TABLE 6

| Sample No. | SR(610)/SRMAX (%) | Finished print color tone |
|---|---|---|
| 201 | 66 | D |
| 202 | 74 | C |
| 203 | 68 | D |
| 204 | 75 | C |
| 205 | 59 | D |
| 206 | 79 | B |
| 207 | 81 | B |
| 208 | 81 | B |
| 209 | 86 | A |
| 210 | 92 | A |
| 211 | 80 | B |
| 212 | 81 | B |
| 213 | 81 | B |
| 214 | 82 | B |
| 215 | 90 | A |

What is claimed is:

1. A silver halide color photographic light-sensitive material comprising a support having thereon a silver halide emulsion layer comprising silver halide grains optically sensitized by a sensitizing dye represented by Formula I, a sensitizing dye represented by Formula II and a sensitizing dye represented by Formula III,

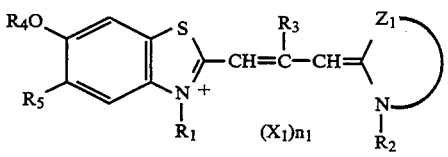

(I)

wherein $R_1$ and $R_2$ are independently an alkyl group having 1 to 10 carbon atoms or an alkenyl group having 3 to 10 carbon atoms; $R_3$ is a hydrogen atom, an alkyl group, an aryl group or a heterocyclic group; $R_4$ and $R_5$ are independently an alkyl group; $Z_1$ is a group of non-metal atoms necessary to form a monocyclic 5-membered nitrogen-containing heterocyclic ring or a bicyclic condensed ring structure including such a 5-membered nitrogen-containing heterocyclic ring; $X_1$ is a counter ion and $n_1$ is the number of counter ions, provided that when an intramolecular salt is formed in the dye, $n_1$ is 0

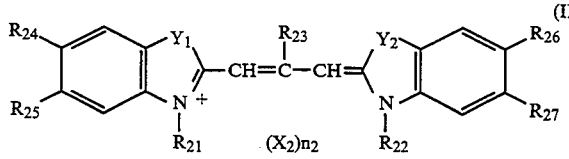

(II)

wherein $R_{21}$ and $R_{22}$ are each an alkyl or an aryl group; $R_{23}$ is a hydrogen atom, an alkyl group, an aryl group or a heterocyclic group; $R_{24}$ and $R_{26}$ are each a hydrogen atom, an alkyl group, an aryl group, a halogen atom, a hydroxy group, an amino group, an acyl group, an acylamino group, an acyloxy group, an aryloxy group, an alkoxycarbonyl group, an aryloxycarbonyl group, an alkoxycarbonylamino group, a sulfonyl group, a carbamoyl group or a cyano group; $R_{25}$ and $R_{27}$ are each a hydrogen atom, an alkyl group, an aryl group, a halogen atom, a hydroxy group, an amino group, an acyl group, an acylamino group, an acyloxy group, an alkoxy group, an aryloxy group, an alkoxycarbonyl group, an aryloxycarbonyl group, an alkoxycarbonylamino group, a sulfonyl group, a carbamoyl group or a cyano group, the groups represented by $R_{24}$ and $R_{25}$, and $R_{26}$ and $R_{27}$ may bind together to form a ring; $Y_1$ and $Y_2$ are each a sulfur atom or a selenium atom; $X_2$ and $n_2$ have the same definition as $X_1$ and $n_1$ in Formula 1;

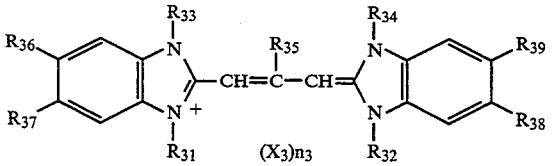

III wherein $R_{31}$, $R_{32}$, $R_{33}$ and $R_{34}$ are each an alkyl group or an aryl group; $R_{35}$ is a hydrogen atom, an alkyl group or an aryl group; $R_{36}$, $R_{37}$, $R_{38}$ and $R_{39}$ are each a hydrogen atom, an alkyl group, an aryl group, a halogen atom, a hydroxy group, an amino group, an acyl group, an acylamino group, an acyloxy group, an alkoxy group, an aryloxy group, an alkoxycarbonyl group, an aryloxycarbonyl group, an alkoxy carbonylamino group, a sulfonly group, a carbamoyl group or a cyano group; groups represented by $R_{36}$ and $R_{37}$ and $R_{38}$ and $R_{39}$ may bind together to form a ring, and $X_3$ and $n_3$ have the same definition as $X_1$ and $n_1$ in Formula 1.

2. The light-sensitive material of claim 1, wherein said silver halide grains are individually comprised of two or more phases different in silver iodide content from each other, and said grains are monodispersed and have a relative standard deviation of silver iodide content of not more than 18%.

3. The light sensitive material of claim 1, wherein at least 50% of the projected area of said silver halide grains is occupied by grains having two or more twin planes.

4. The light sensitive material of claim 1 wherein at least one of the groups represented by $R_1$ and $R_2$ of Formula 1 is substituted by a sulfo group, a carboxy group, a hydroxy group, or a phosphono group.

5. The light-sensitive material of claim 1, wherein the nitrogen-containing heterocyclic ring represented by $Z_1$ of Formula I is an oxazole ring, a condensed ring including an oxazole ring, a thiazole ring or a condensed ring including a thiazole ring.

* * * * *